US005441166A

United States Patent [19]

Lucas, Jr. et al.

[11] Patent Number: 5,441,166

[45] Date of Patent: Aug. 15, 1995

[54] DOME COVER FOR TRAY OR PAN

[75] Inventors: Earl S. Lucas, Jr., Glen Allen; Frank J. Rocco, Richmond, both of Va.

[73] Assignee: Reynolds Metals Company, Richmond, Va.

[21] Appl. No.: 213,274

[22] Filed: Mar. 15, 1994

[51] Int. Cl.[6] ..... B65D 41/18

[52] U.S. Cl. ..... 220/306; 220/356; 206/45.32; D7/392.1; D9/429

[58] Field of Search ..... 220/670, 674, 669, 675, 220/306; 206/45.32; 312/284; D9/424, 429, 431; D7/610, 392.1

[56] References Cited

U.S. PATENT DOCUMENTS

| | | | |
|---|---|---|---|
| Re. 28,720 | 2/1976 | Sedlak | 206/501 |
| D. 290,232 | 6/1987 | Holzkopf et al. | D9/424 |
| D. 306,974 | 4/1990 | Tholstrup | D9/424 |
| D. 352,000 | 11/1994 | Hansen et al. | D9/429 |
| 2,246,695 | 6/1941 | Phillips | 312/284 |
| 3,070,257 | 12/1962 | Bojanowski | 206/508 |
| 3,117,692 | 1/1964 | Carpenter et al. | 206/501 X |
| 3,303,964 | 2/1967 | Luker | 220/306 |
| 3,690,902 | 9/1972 | Dahl | 206/45.32 X |
| 4,061,241 | 12/1977 | Retelny | 206/508 X |
| 4,206,845 | 6/1980 | Christian | 206/508 |
| 4,206,854 | 6/1980 | Takami | 222/478 |
| 4,375,862 | 3/1983 | Kurinsky et al. | 312/284 X |
| 4,450,960 | 5/1984 | Johnson | 206/334 |
| 4,452,356 | 6/1984 | Dahl | 206/45.32 |
| 4,535,889 | 8/1985 | Terauds | 206/527 |
| 4,741,452 | 5/1988 | Holzkopf | 220/306 |
| 4,776,459 | 10/1988 | Beckerman et al. | 206/45.32 |
| 4,844,263 | 7/1989 | Hadtke | 206/508 |
| 4,863,058 | 9/1989 | Antoni et al. | 220/675 |
| 4,867,303 | 9/1989 | Beckerman et al. | 206/45.32 |
| 4,874,083 | 10/1989 | Antoni et al. | 206/45.32 |
| 5,287,959 | 2/1994 | Hansen et al. | 220/675 |

FOREIGN PATENT DOCUMENTS

| | | |
|---|---|---|
| 261894 | 5/1963 | Australia . |
| 3146676A1 | 6/1983 | Germany . |
| 1145924 | 3/1969 | United Kingdom . |

*Primary Examiner*—Stephen P. Garbe
*Assistant Examiner*—Rolain Ahylton
*Attorney, Agent, or Firm*—Alan T. McDonald

[57] ABSTRACT

A cover or lid of lightweight relatively flexible material including a circular top having a plurality of first planar segments circumferentially spaced along the circular top. Each first planar segment is connected to an adjoining first planar segment by a plurality of first inclined surfaces defining a plurality of first trapezoidal grooves. A sidewall is integrally formed with and extends downwardly from a peripheral edge of the circular top. The sidewall has a plurality of second planar segments circumferentially spaced along the sidewall with each second planar segment connected to an adjoining second planar segment by a plurality of second inclined surfaces defining a plurality of second trapezoidal grooves. The plurality of first planar segments and first trapezoidal grooves of the circular top are aligned with the plurality of second planar segments and second trapezoidal grooves of the sidewall.

6 Claims, 3 Drawing Sheets

DOME COVER FOR TRAY OR PAN

FIELD OF THE INVENTION

This invention relates generally to lightweight covers for food presented on a pan or tray, and more specifically, to plastic dome covers having improved stability.

BACKGROUND

In recent years, there has been an increase in prepared foods presented on pans and/or trays for sale or catering. Consequently, there is increased demand for inexpensive lightweight disposable covers or lids for use with such pans and/or trays to provide a covered container. Such covers normally are dome-shaped and are made of see-through or transparent plastic materials in order for the food to be observed. To minimize cost, it is desirable for the cover to be made of a minimum amount of plastic material, but still have sufficient stability to protect the food.

To provide improved stability, it is known to provide stiffening ribs in the surfaces of such covers as shown in U.S. Pat. Nos. 3,690,902 and 3,303,964. However, such prior stiffening ribs do not provide satisfactory stability as the thickness of plastic material is decreased to reduce the cost of the covers.

SUMMARY OF THE INVENTION

Accordingly, an advantage of the present invention is providing a lightweight container cover which is inexpensive and has high stability.

Another advantage is providing a covered food container having an inexpensive lid or cover made of lightweight relatively flexible material having high stability.

Still another advantage of the present invention is to provide a cover of lightweight relatively flexible material having a novel surface structure which is attractive and increases stability for any thickness of material used.

A cover or lid of lightweight relatively flexible material according to the present invention includes a circular top having a plurality of first planar segments circumferentially spaced along the circular top, with each first planar segment connected to an adjoining first planar segment by a plurality of first inclined surfaces defining a plurality of first trapezoidal grooves. A sidewall is integrally formed with and extends downwardly from a peripheral edge of the circular top with the sidewall having a plurality of second planar segments circumferentially spaced along the sidewall with each second planar segment connected to an adjoining second planar segment by a plurality of second inclined surfaces defining a plurality of second trapezoidal grooves.

One feature of the invention is that the plurality of first planar segments and first trapezoidal grooves of the circular top are aligned with the plurality of second planar segments and second trapezoidal grooves of the sidewall.

Another feature of the invention is that the circular top further comprises a flat circular recess formed at the center and provided with a raised flat annular surface interposed between the flat circular recess and the plurality of first planar segments and first trapezoidal grooves.

Still another feature of the invention is that the plurality of first planar segments and first trapezoidal grooves extend radially from a center of said circular top.

These and other advantages of the present invention will become apparent upon reference to the following drawings, specification and appended claims.

DESCRIPTION OF THE INVENTION

A cover or lid is provided for food presented on a pan and/or tray and is preferably dome-shaped. The cover is preferably formed as a unitary item by vacuum or thermoforming operations on a sheet of transparent thermoplastic material having a thickness in the range of 0.010 inches to 0.030 inches. While it is possible to use thicker material, this would increase the cost of the cover without advantage. In addition, although the sheet of thermoplastic material is normally transparent because it is customary for the food to be observable, it is certainly within the scope of the present invention for the sheet of thermoplastic material to be opaque.

Figure 1:
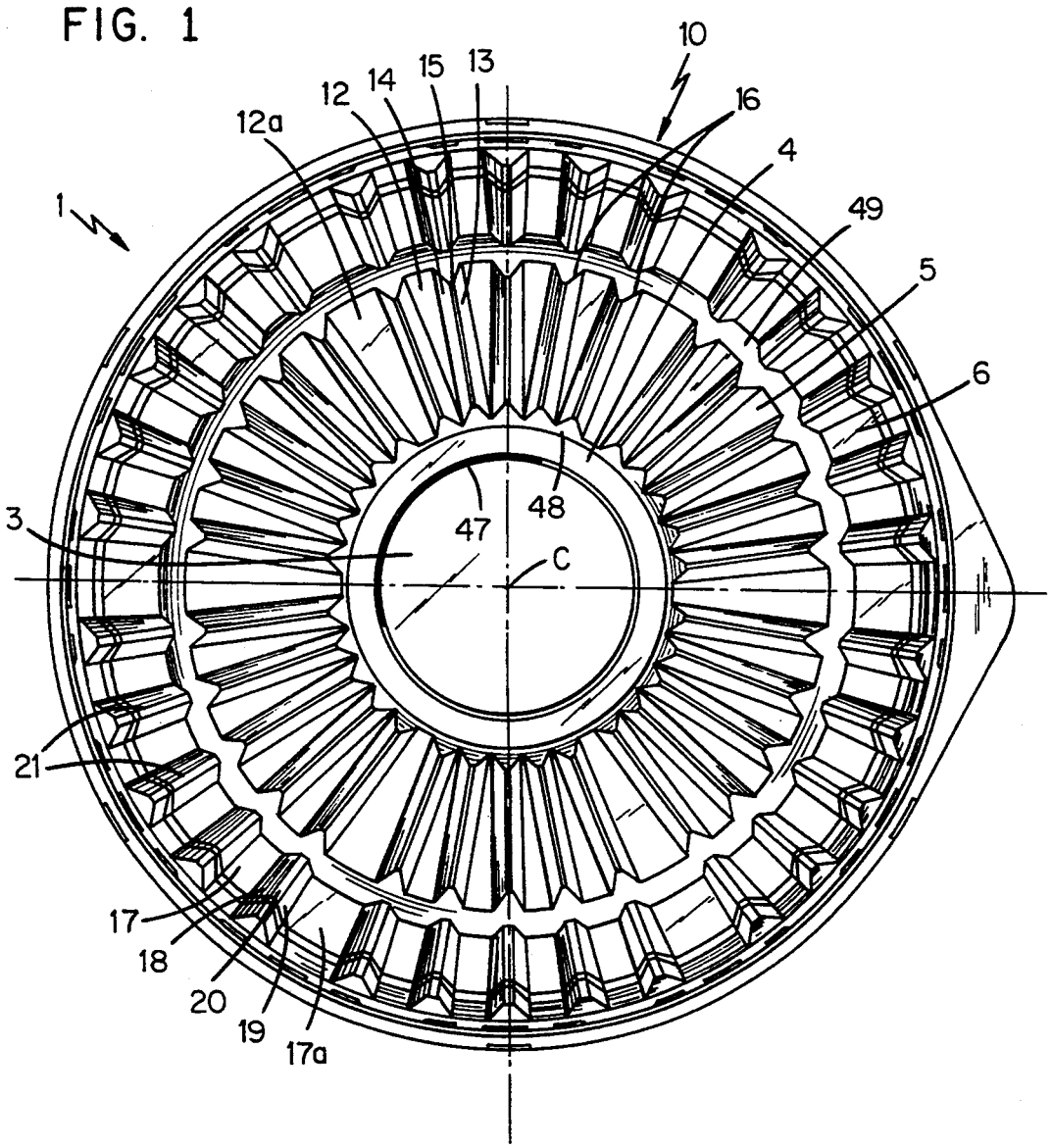
FIG. 1 is a top view of the cover according to the invention.
Figure 2:
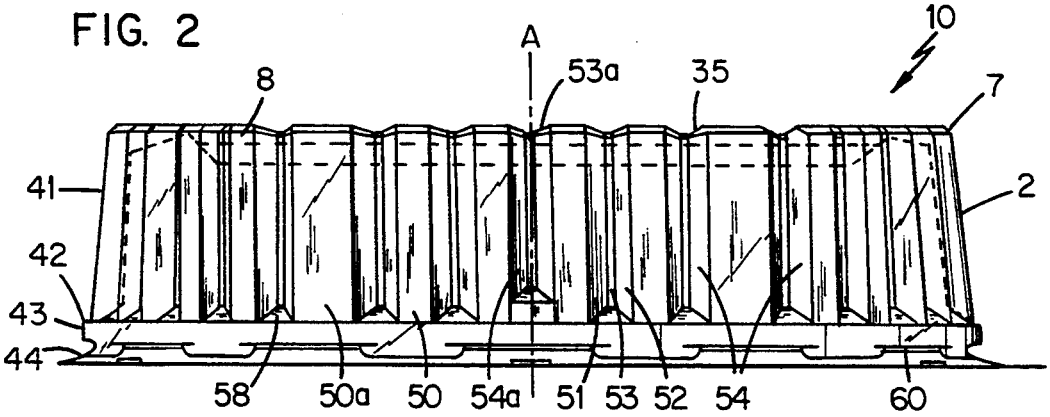
FIG. 2 is a side view of the cover.
Figure 3:
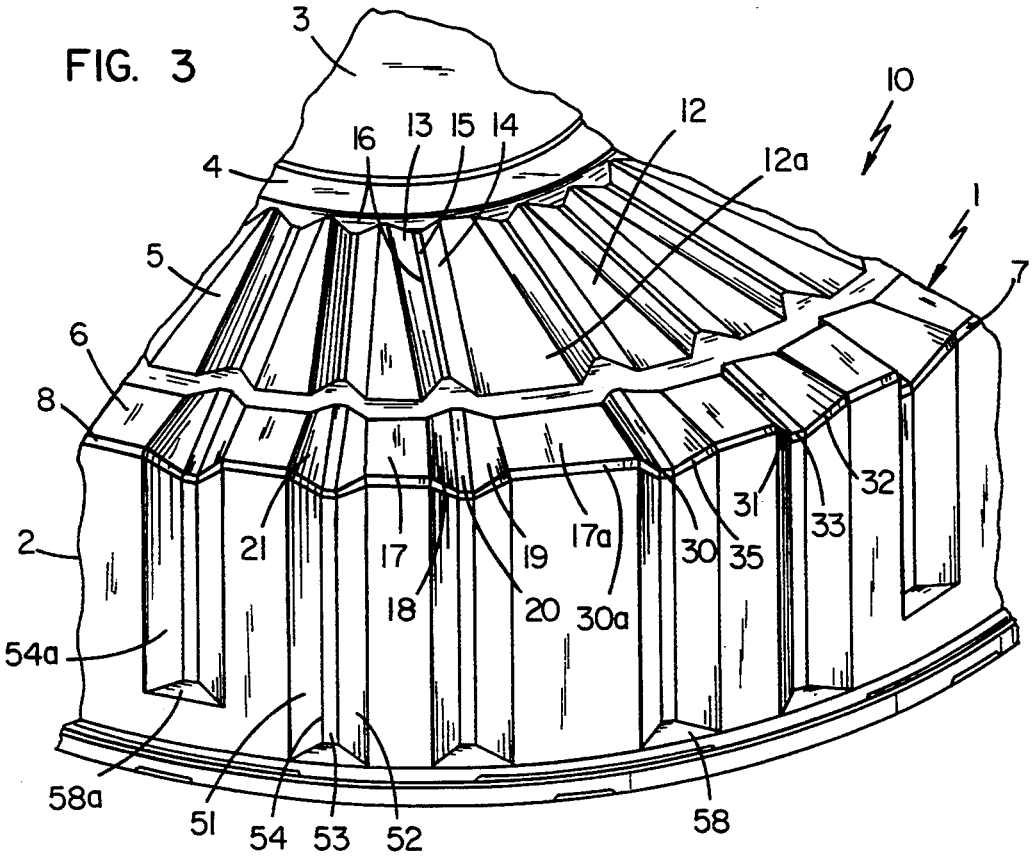
FIG. 3 is a fragmentary view of the top and side of the cover.

Referring to FIGS. 1 through 3, there is shown a cover which is generally of a dome-shaped configuration with a circular top 1 and an a sidewall 2 which is an annular depending sidewall extending outwardly and downwardly from the peripheral edge of the circular top. FIG. 1 shows the circular top 1 of the dome cover 10. The circular top 1 has a flat circular recess 3 lying substantially in a plane perpendicular to the axis A (FIG. 2) of the circular top, a flat annular portion 4 formed outside the flat circular recess 3 and lying substantially in a plane parallel to the flat circular recess, a first segmented annular portion 5 formed outside the flat annular portion 4, a second segmented annular portion 6 formed outside the first segmented annular portion 5, and a third segmented annular portion 7 formed outside and adjacent to the second segmented annular portion 6 along the periphery of the circular top 1. The flat annular portion 4 aids in preventing the possibility of fracture across the circular top.

Figure 4:
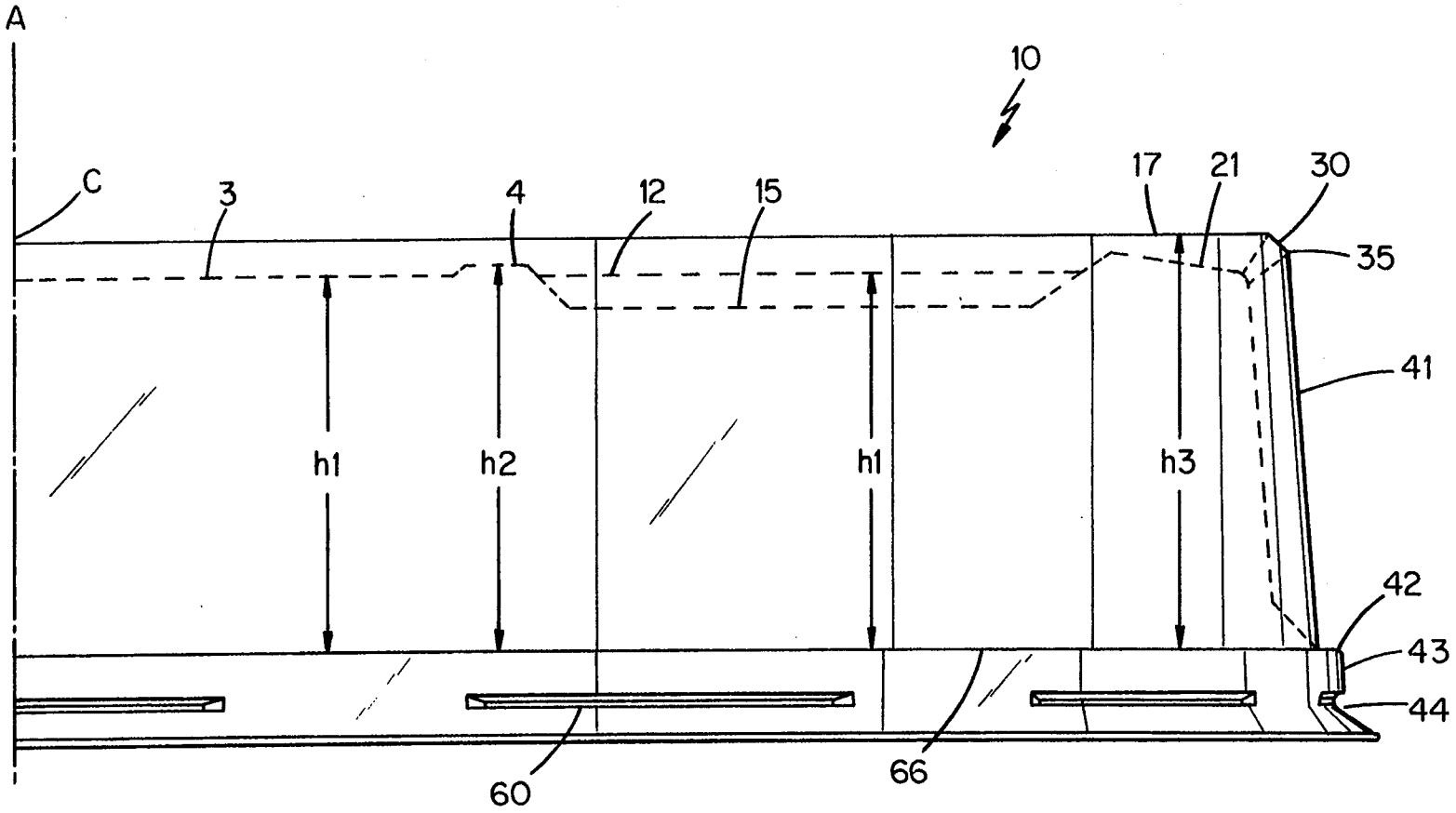
FIG. 4 is a profile view looking through the right half of the cover of FIG. 2 with the exterior segments and grooves removed.

Referring to FIGS. 1, 3 and 4, the main surface of the first annular segmented portion 5 includes a plurality of radially extending planar segments (lands) 12, **12*a*, which are also referred to as a plurality of first size planar segments and a plurality of second size planar segments respectively, with the main surface of each planar segment lying substantially in the plane of the flat circular recess 3. Each planar segment 12, 12*a* is connected to an adjacent planar segment by inclined surfaces 13 and 14 and lower rectangular surface 15 defining a radially extending trapezoidal groove or channel 16. Surfaces 13 and 14 are symmetrical and intersect the plane of the main surface of each planar segment at acute angles. The base of the trapezoidal groove 16 is delineated by lower rectangular surface 15 which has a width smaller than the maximum separation between adjacent planar segments 12, 12*a***.

The second annular segmented portion 6 also includes a plurality of radially extending planar segments 17, 17*a*, which are also referred to as a plurality of third size planar segments and a plurality of fourth size planar segments respectively. The main surface of each planar segment lies substantially in a plane which is parallel to the plane of the flat circular recess 3. Each planar segment 17, 17*a* is connected to an adjacent planar segment by inclined surfaces 18 and 19 and lower rectangular surface 20 defining a radially extending trapezoidal groove 21. Surfaces 18 and 19 are symmetrical and intersect the plane of the main surface of each planar segment 17, 17*a* at acute angles. The base of the trapezoidal groove 21 is delineated by lower rectangular surface 20 which has a width smaller that the maximum separation between adjacent planar segments 17, 17*a*. However, while the lower surface 15 of each of the trapezoidal grooves 16 of the first annular segmented portion 5 is parallel to the plane of the flat circular recess, the lower rectangular surface 20 of each of the trapezoidal grooves 21 of the second annular segmented portion 6 is in a plane which is inclined with respect to the plane formed by the flat circular recess 3. Thus, each trapezoidal groove 21 of the second annular segmented portion has the end which is furthest from the axis A positioned at a greater depth from the plane of the main surface of the segments 17, 17*a* than the end positioned nearest the axis A.

Referring to FIG. 3, the third annular segmented portion 7 also includes a plurality of radially extending planar segments 30, 30*a*, which are also referred to as a plurality of fifth size planar segments and a plurality of sixth size planar segments respectively. However, the main surface of each planar segment of the third segmented annular portion lies in a different plane with each plane intersecting the plane of the main surface of the planar segments of the second segmented annular portion 6 at a common acute angle. Each planar segment 30, 30*a* is connected to an adjacent planar segment by inclined surfaces 31 and 32 and lower rectangular surface 33 defining a radially extending trapezoidal groove 35. Surfaces 31 and 32 are symmetrical and intersect the plane of the main surface of each planar segment 30, 30*a* at acute angles. The base of the trapezoidal groove 35 is delineated by lower rectangular surface 33. Each lower rectangular surface 33 lies also in a different plane with each plane also intersecting the plane of the main surface of the segments of the second segmented annular portion 6 at the same acute angle as does each planar segment 30, 30*a* and has a width smaller than the maximum separation between adjacent planar segments 30, 30*a*. Since the planar segments and lower rectangular surfaces of the third segmented annular portion 7 are circumferentially distributed around the periphery of the circular top, they approximate a frusto conical surface at the periphery of the circular top, giving the periphery a beveled appearance.

The plurality of planar segments in the first annular segmented portion 5 comprises a plurality of first size planar segments 12 and a plurality of second size planar segments 12*a*, larger than the first size planar segments. The plurality of planar segments in the second annular segmented portion 6 comprises a plurality of third size planar segments 17 and a plurality of fourth size planar segments 17*a*, larger than the third size planar segments. Similarly, the plurality of planar segments in the third annular segmented portion 7 comprises a plurality of fifth size planar segments 30 and a plurality of sixth size planar segments 30*a*, larger than the fifth size planar segments.

The first, third and fifth size planar segments in each of the corresponding annular segmented portions 5, 6, 7 are each formed in a plurality of groups with each group separated by a corresponding second, fourth and sixth size planar segment. Each of the groups of first, third and fifth size planar segments has an equal number X1 of planar segments and an equal number X1+1 of trapezoidal grooves. However, the actual number of first, third and fifth size planar segments and trapezoidal grooves in each group can vary, depending on the diameter of the dome cover. The radial extension of each planar segment and trapezoidal groove of each annular segmented portion 5, 6 and 7 is aligned with corresponding planar segments and trapezoidal grooves of the other segmented portions. With a circular top of approximately 11 inches in diameter as depicted in FIG. 1, six groups are provided for each of the first, third and fifth size planar segments with each group having four planar segments and five trapezoidal grooves.

Referring to FIG. 4, the annular depending sidewall 2 comprises upper annular depending sidewall 41 which extends to a first flange 42 which is an outwardly projecting flange and an upper circumferential flange and a lower annular depending sidewall 43 which extends from the outer periphery of the first flange to an outwardly projecting second flange 44. The second flange 44 which is a lower circumferential flange and the outward inclination of the sidewall 41 enable the covers to be easily stacked for storage.

As shown in FIG. 4, with respect to the plane formed by the upper peripheral edge 66 of the first flange 42, the flat circular recess 3 and the main surface of the planar segments 12 of the first segmented annular portion 5 are formed at a height h1, the flat annular member 4 is formed at a height h2>h1, and the main surface of the planar segments 17 of the second segmented annular portion 6 are formed at a height h3>h2. Since the height of adjacent portions vary, transitional surfaces are necessary to connect adjacent portions. Concentric transitional surfaces 47, 48, 49 (FIG. 1) are provided for this purpose with each transitional surface forming a frusto conical surface. No transitional surface is necessary between the second segmented annular portion 6 and the third segmented annular portion 7.

Referring again to FIGS. 2 and 3, the upper annular depending sidewall 41 has a plurality of planar segments 50, 50*a*, which are also referred to as a plurality of seventh size planar segments and a plurality of eighth size planar segments respectively, extending along the main surface of sidewall 2. Each planar segment 50, 50*a* is connected to an adjacent planar segment by inwardly inclined surfaces 51 and 52 and bottom rectangular surface 53 defining a trapezoidal groove or channel 54 extending substantially parallel to the adjacent planar segments 50, 50*a*. Surfaces 51 and 52 are symmetrical and intersect the plane of the main surface of each planar segment 50, 50a at acute angles. The base of the trapezoidal groove 53 is delineated by bottom rectangular surface 53, 53*a* which has a width smaller than the maximum separation between adjacent planar segments 50, 50*a*.

The plurality of planar segments of the upper annular depending sidewall 41 comprise a plurality of seventh size planar segments 50 and a plurality of eighth size planar segments 50*a*, larger than the seventh size planar segments. The seventh size planar segments are formed in a plurality of groups with each group separated by an eighth size planar segment. The plurality of seventh and eighth size planar segments and trapezoidal grooves of the upper annular depending sidewall are symmetrically positioned around the axis A of the circular top. In addition, each planar segment 50, 50*a* and trapezoidal groove 53 is aligned with the corresponding planar segments and trapezoidal grooves of the first, second and third annular segmented portions 5, 6, 7 so that the plane of the centerline of each planar segment and trapezoidal groove of the annular segmented portions 5, 6, 7 extending from the axis A, bisects a respective planar segment and trapezoidal groove of the upper annular depending sidewall 41.

The vertical planar segments of the upper annular depending sidewall 41 extend from the peripheral edge 8 of the circular top to the first flange 42. The bottom rectangular surface 53, 53*a* of the trapezoidal grooves 54 extends from the flat rectangular surface 33 of the third annular segmented portion 7 and merges into a lower transitional surface 58 or 58*a* which approximate a frusto conical surface around the axis A of the circular top.

Each of the trapezoidal grooves 54 are of equal length except for those designated at 54*a* which has the bottom rectangular surface 53*a* terminating at a greater distance above the first flange 42 than the bottom rectangular surfaces 53 of trapezoidal grooves 54. It has been found that stability is improved if at least one trapezoidal groove 54*a* is included in each group of seventh size planar segments. The number and distribution of such trapezoidal grooves 54*a* in each group of seventh size planar segments will vary, depending on the diameter of the cover.

The planar segments and trapezoidal grooves of the circular top 1 and the sidewall 2 contribute to the improved stability of the cover as well as provide an attractive design.

Figure 5:
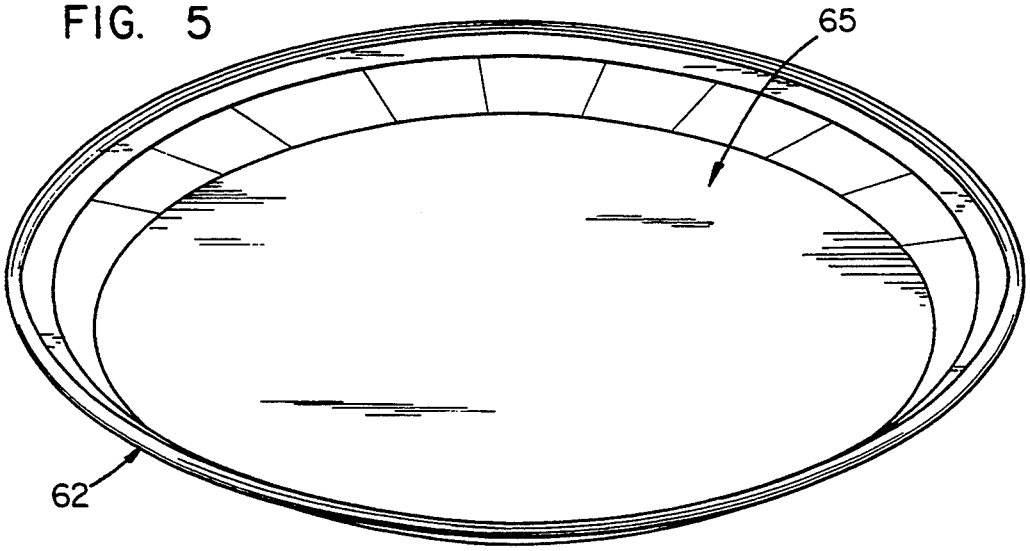
FIG. 5 is a plan view of a pan or tray to be used with the cover.

Lower annular depending sidewall 43 has a plurality of symmetrically spaced, horizontally extending, and inwardly formed depressions 60. These depressions are sized and shaped to engage the lower peripheral lip 62 of a suitably sized pan or tray 65, as shown in FIG. 5. thereby "locking" the dome cover to the pan or tray.

The height of the sidewall 2 above the plane formed by the upper peripheral edge 66 of the first flange 42 (FIG. 4) can vary as desired. However, the height should be sufficient to cover the item(s) on the pan or tray without touching them. With the circular top of approximately 11 inches in diameter depicted in FIG. 1, a height of approximately 3 inches has been found to be satisfactory. For convenience of manufacture and stability of the plastic material when formed, all edges of the cover which are formed by the intersection of two surfaces are typically rounded so as not to form a sharp edge.

While the invention has been illustrated and described in detail in the drawings and foregoing description, it is clearly understood that the same is to be considered as illustrative and not restrictive in character, it being understood that the spirit and scope of the present invention being limited only by the terms of the appended claims.

What is claimed is:

1. A cover of lightweight relatively flexible material used for displaying and packing food comprising:

a circular top comprising:

a flat circular recess formed at the center of said circular top at a first height, a flat annular surface adjacent said flat circular recess, a plurality of first radially extending planar segments circumferentially spaced along said circular top adjacent said flat annular surface with each first radially extending planar segment connected to an adjoining first radially extending planar segment by a plurality of first radially extending surfaces defining a plurality of first radially extending trapezoidal grooves, and a plurality of second radially extending planar segments circumferentially spaced along said circular top radially spaced from said plurality of first radially extending planar segments and trapezoidal grooves with each second radially extending planar segment connected to an adjoining second radially extending planar segment by a plurality of second radially extending surfaces defining a plurality of second radially extending trapezoidal grooves; and a side wall integrally formed with and extending downwardly from a peripheral edge of said circular top to a circumferential flange, said sidewall having a plurality of planar segments circumferentially spaced along the sidewall with each planar segment connected to an adjoining planar segment by a plurality of surfaces defining a plurality of trapezoidal grooves.

2. The cover of claim 1, wherein said side wall has an upper circumferential flange and a lower circumferential flange, said flat circular recess and plurality of first radially extending planar segments being at a first height above the lower circumferential flange, said flat annular surface is at a second height, greater than the first height, above the lower circumferential flange, and said plurality of second radially extending planar segments are at a third height, greater than the second height, above the lower circumferential flange.

3. The cover of claim 2, wherein said circular top further includes a plurality of third radially extending planar segments circumferentially spaced along the peripheral edge of said circular top adjacent said plurality of second radially extending planar segments and trapezoidal grooves with each third radially extending planar segment connected to an adjoining third radially extending planar segment by a plurality of third radially extending surfaces defining a plurality of third radially extending trapezoidal grooves.

4. The cover of claim 3, wherein the plurality of first, second and third radially extending planar segments and trapezoidal grooves of the circular top are aligned with the plurality of planar segments and trapezoidal grooves of said sidewall.

5. The cover of claim 1, wherein said side wall has an upper circumferential flange and a lower circumferential flange, said side wall comprising:

an upper depending side wall extending downward from said peripheral edge to said upper circumferential flange, and a lower depending side wall extending downwardly from said upper circumferential flange to said lower circumferential flange, said plurality of planar segments and trapezoidal grooves being circumferentially spaced along the upper depending side wall, and said lower depending side wall including a plurality of circumferentially space depressions.

6. A food container comprising:

a base for supporting food and having a peripheral edge; and a cover of lightweight relatively flexible material, said cover comprising:

a circular top comprising:

a flat circular recess formed at the center of said circular top at a first height, a flat annular surface adjacent said flat circular recess, a plurality of first radially extending planar segments circumferentially spaced along said circular top adjacent said flat annular surface with each first radially extending planar segment connected to an adjoining first radially extending planar segment by a plurality of first radially extending surfaces defining a plurality of first radially extending trapezoidal grooves, and a plurality of second radially extending planar segments circumferentially spaced along said circular top radially spaced from said plurality of first radially extending planar segments and trapezoidal grooves with each second radially extending planar segment connected to an adjoining second radially extending planar segment by a plurality of second radially extending surfaces defining a plurality of second radially extending trapezoidal grooves; and a sidewall integrally formed with and extending downwardly from a peripheral edge of said circular top to a lower flange, said sidewall comprising:

an upper depending sidewall having a plurality of planar segments circumferentially spaced along the sidewall with each planar segment connected to an adjoining planar segment by a plurality of surfaces defining a plurality of trapezoidal grooves, and a lower depending sidewall having a plurality of circumferentially spaced depressions for engaging the peripheral edge of the base.

* * * * *